US005592954A

United States Patent [19]

Case et al.

[11] Patent Number: 5,592,954

[45] Date of Patent: Jan. 14, 1997

[54] MEASURING CIGARETTE PRESSURE DROP

[75] Inventors: Paul D. Case; William J. Stone, both of Southampton, United Kingdom

[73] Assignee: British-American Tobacco Company Limited, Middlesex, England

[21] Appl. No.: 400,276

[22] Filed: Mar. 3, 1995

Related U.S. Application Data

[63] Continuation of Ser. No. 967,516, Oct. 28, 1992, abandoned.

[30] Foreign Application Priority Data

Nov. 16, 1991 [GB] United Kingdom ..... 9124411

[51] Int. Cl.[6] ..... A24C 5/14

[52] U.S. Cl. ..... 131/84.1; 131/28; 131/904

[58] Field of Search ..... 131/84, 1, 904, 131/280, 28

[56] References Cited

U.S. PATENT DOCUMENTS 4,811,744 3/1989 Ulrich et al. ..... 131/84.1

*Primary Examiner*—Mark S. Graham

*Attorney, Agent, or Firm*—Kane, Dalsimer, Sullivan, Kurucz, Levy, Eisele and Richard

[57] ABSTRACT

A cigarette making machine is provided with a pressure drop measuring unit (1) located at or close to the garniture of the making machine. The pressure drop of a gas stream of constant volume is introduced into the compacted tobacco rod beneath the format finger (2) on the making machine at a point at which that pressure drop measurement correlates with the bound pressure drop of the finished cigarette. The unbound cigarette pressure drop or draw resistance experienced by the smoker can be calculated using the bound tobacco rod pressure drop obtained by correlation with the measured pressure drop across the rod in an algorithim processed by calculation means. The degree of ventilation of the cigarette may also be utilised in the algorithim calculation. Comparator means allows the unbound cigarette pressure drop to be maintained within pre-set limits by varying cigarette parameters which affect the overall unbound cigarette pressure drop.

23 Claims, 2 Drawing Sheets

MEASURING CIGARETTE PRESSURE DROP

This application is a continuation of application Ser. No. 07/967,516, filed Oct. 28, 1992, now abandoned.

BACKGROUND OF THE INVENTION

1. Field of the Invention

This invention relates to a method and apparatus for measuring cigarette pressure drop.

2. Brief Description of Related Art

The draw resistance of a cigarette, or other smoking article, is a major determinant of the draw characteristic(s) of the cigarette which are experienced by a smoker. The draw resistance of a cigarette refers to the resistance of the tobacco rod, and filter element if present, to air flowing therealong. The draw resistance perceived by a smoker can be measured quantitatively by the pressure drop or difference in static pressure between the two ends of a sample cigarette at a fixed air flow rate of 17.5 ml $sec^{-1}$. As used herein, the phrases 'cigarette pressure drop' or 'pressure drop of a cigarette' mean the measured difference in static pressure between the two ends of the cigarette at the fixed flow rate.

The pressure drop of a ventilated filter cigarette can be measured either with the ventilation holes of the filter element open, i.e. the unbound cigarette pressure drop, or with the ventilation holes closed, i.e. the bound cigarette pressure drop. The bound pressure drop of a filter cigarette can be measured by enclosing the full length of the cigarette in a rubber sleeve, such as in one method which can be carried out on the Filtrona Auto P.D. device. Alternatively, the bound pressure drop can be measured by only enclosing a predetermined length of the filter element of the cigarette which, length includes the ventilation holes. This method can also be carried out on the Filtrona Auto P.D. device. Unbound pressure drop measurements can also be made using the Auto P.D. Device whereby the ventilation holes are left open by the rubber sleeve. Another apparatus, the Filtrona Cigarette Test Station, encloses the filter element and the ventilation holes to provide a bound cigarette pressure drop measurement or, alternatively, the ventilation holes can be left open to provide an unbound cigarette pressure drop measurement. The pressure drop of a cigarette has, until recently, only been determined by measuring each finished cigarette in an individual fashion, known as static measurement. However, in U.S. Pat. No. 4,811,744 to which attention is directed, there was disclosed an apparatus for measuring, in a continuous fashion, the on-line pressure drop across a rod of tobacco fibres. The pressure drop across the rod is measured at that point in the format finger on the cigarette making machine where the rod is compacted to a diameter which is substantially the same as the diameter of the finished cigarette, i.e. an on-line pressure drop measurement is taken. This pressure drop measurement correlates very well with the usual static measurement of the pressure drop along a finished cigarette, at the same tobacco density or tobacco rod weight. As the cigarette is enclosed along its length in the format finger the pressure drop is effectively a bound pressure drop measurement. This device, though, is not effective to give a correlation with the unbound pressure drop of a ventilated cigarette.

This invention has as an object the provision of a method for determining the unbound pressure drop of a ventilated plain or filter-tipped cigarette, which pressure drop is indicative of the draw resistance of a cigarette experienced by a smoker. The unbound pressure drop is of considerable practical importance in the production of cigarettes to a particular unbound pressure drop value or range.

The method of determining the unbound pressure drop of a cigarette according to the invention could be utilised to predict, for theoretical purposes say, the unbound pressure drop of any ventilated filter-tipped or plain cigarette, but is preferably configured to predict continuously the on-line unbound pressure drop of a specific cigarette, i.e. a cigarette having a particular desired level of ventilation.

SUMMARY OF THE INVENTION

The present invention provides a method of determining cigarette pressure drop comprising measuring the pressure drop across a rod of tobacco fibres as the rod is formed on a cigarette making machine at a point along the rod where the pressure drop measured at that point correlates with the bound tobacco rod pressure drop of the rod in a finished condition, and calculating the unbound cigarette pressure drop of a finished ventilated plain or filter-tipped cigarette by calculation means utilising the bound tobacco rod pressure drop obtained by correlation with the measured pressure drop across the rod.

The present invention also provides a cigarette pressure drop measuring system adapted to measure pressure drop across a rod of tobacco fibres as the rod is formed on a cigarette making machine at a point along the rod where the pressure drop measured at that point correlates with the bound tobacco rod pressure drop of the rod in a finished condition, there being further provided calculation means for calculating the unbound pressure drop of a finished ventilated plain or filter-tipped cigarette, the calculation means utilising the bound tobacco rod pressure drop obtained by correlation with the measured pressure drop across the rod.

If a filter-tipped cigarette is provided, preferably it is the filter element which is provided with ventilation means. Ventilation means may suitably be provided as ventilation perforations.

Preferably the degree of ventilation of the finished cigarette may be utilised in the calculation of the unbound cigarette pressure drop. The degree of ventilation of the finished cigarette depends on the number of ventilation holes provided as the ventilation means, the size of the ventilation holes and the position of the ventilation holes along the tobacco rod length, in respect of a plain cigarette, or along the filter element length, in respect of a filter-tipped cigarette.

The degree of ventilation of the finished cigarette may be determined by means of a ventilation meter in association with the cigarette making machine and suitably being present on a filter tip assembly machine, for example, when filter-tipped cigarettes are being produced. The ventilation meter is suitably arranged to provide a measurement of the degree of ventilation, which measurement may be given as a percentage ventilation measurement.

In the alternative, where the ventilation of the filter is achieved by the provision of a tipping wrapper having been prior provided with means to produce a known and desired degree of ventilation, the tipping wrapper being utilised in conjunction with a porous filter plugwrap or self-sustaining filter rod, the method provides for feeding of the value of the desired degree of ventilation to the calculation means.

The method preferably further comprises the steps of comparing the calculated or desired unbound cigarette pressure drop value with a pre-set target unbound pressure drop value or a range of values, and either varying a cigarette parameter or parameters to maintain the unbound cigarette pressure drop to the target value or within the target range, or rejecting those cigarettes which do not have an unbound pressure drop value within the desired range or of the desired value. The cigarette parameter(s) may be varied by controlling the degree of ventilation of the cigarette or the pressure drop of the rod by varying the length thereof or the tobacco weight thereof, or moving the position of the ventilation perforations either along the tobacco rod or the filter element, if provided.

If a ventilation meter is provided it is preferably linked, by means of the provision of a feedback signal, with a laser perforator which perforates the tipping wrapper either as the wrapper is supplied to the filter-tip assembly machine, or once the wrapper is wrapped about an abutting filter element and tobacco rod length. By means of the feedback signal, the laser settings can be regulated to keep the degree of ventilation to a target level or within a target range. The laser settings include, for example, the power of the laser, the size of hole produced and the pulse time of the laser.

In the alternative, where a tipping wrapper of a desired degree of ventilation is utilised, the wrapper may be changed to one having a different degree of ventilation or the pressure drop of the tobacco rod may be varied, by increasing the rod weight or varying the porosity of the underlying plugwrap, for example, to maintain the unbound cigarette pressure drop within the pre-set target level.

The measuring system may suitably comprise a ventilation meter, which meter is preferably associated with a laser perforator on the filter-tip assembly machine.

Preferably the measuring system further comprises comparator means operable to compare the derived cigarette unbound pressure drop value with a pre-defined unbound cigarette pressure drop target value or values, and means to vary a parameter of the cigarette to maintain the unbound cigarette pressure drop value to or within the pre-set limits. In the alternative, rejection means may be provided to reject those cigarettes which do not have an unbound cigarette pressure drop value within the pre-set limits or of the pre-set value.

Suitably, control of the degree of ventilation of the cigarette may be effected by varying the laser settings of the laser perforator to control, for example, the size, position and number of perforations.

The measuring system may, in an alternative, be fed with the known degree of ventilation of a particular porous tipping wrapper to be utilised in combination with a porous plugwrap or self-sustaining filter rod. The porosity of the tipping wrapper may be natural or be a result of pre-perforation. For the purposes of the present invention it is believed that the effect of paper porosity has a negligible effect on the tobacco rod pressure drop. Thus, no mention of paper porosity/permeability is made in the algorithms utilised herein.

The unbound cigarette pressure drop for a system according to the present invention may be calculated using an algorithm which takes into account the bound pressure drop of the tobacco rod, the pressure drop of one or more filter element(s), if present, and the ventilation characteristics of the cigarette. The algorithm will need to be varied as described below if a multi-element filter cigarette is to be produced on the filter tip assembly machine.

Preferably the calculation of the cigarette unbound pressure drop is continuously calculated in order to provide a means of continuously monitoring the unbound cigarette pressure drop.

Reference will now be made, by way of example, to the accompanying diagrammatic drawings in which:

DETAILED DESCRIPTION OF THE PREFERRED EMBODIMENTS OF THE INVENTION

Figure 1:
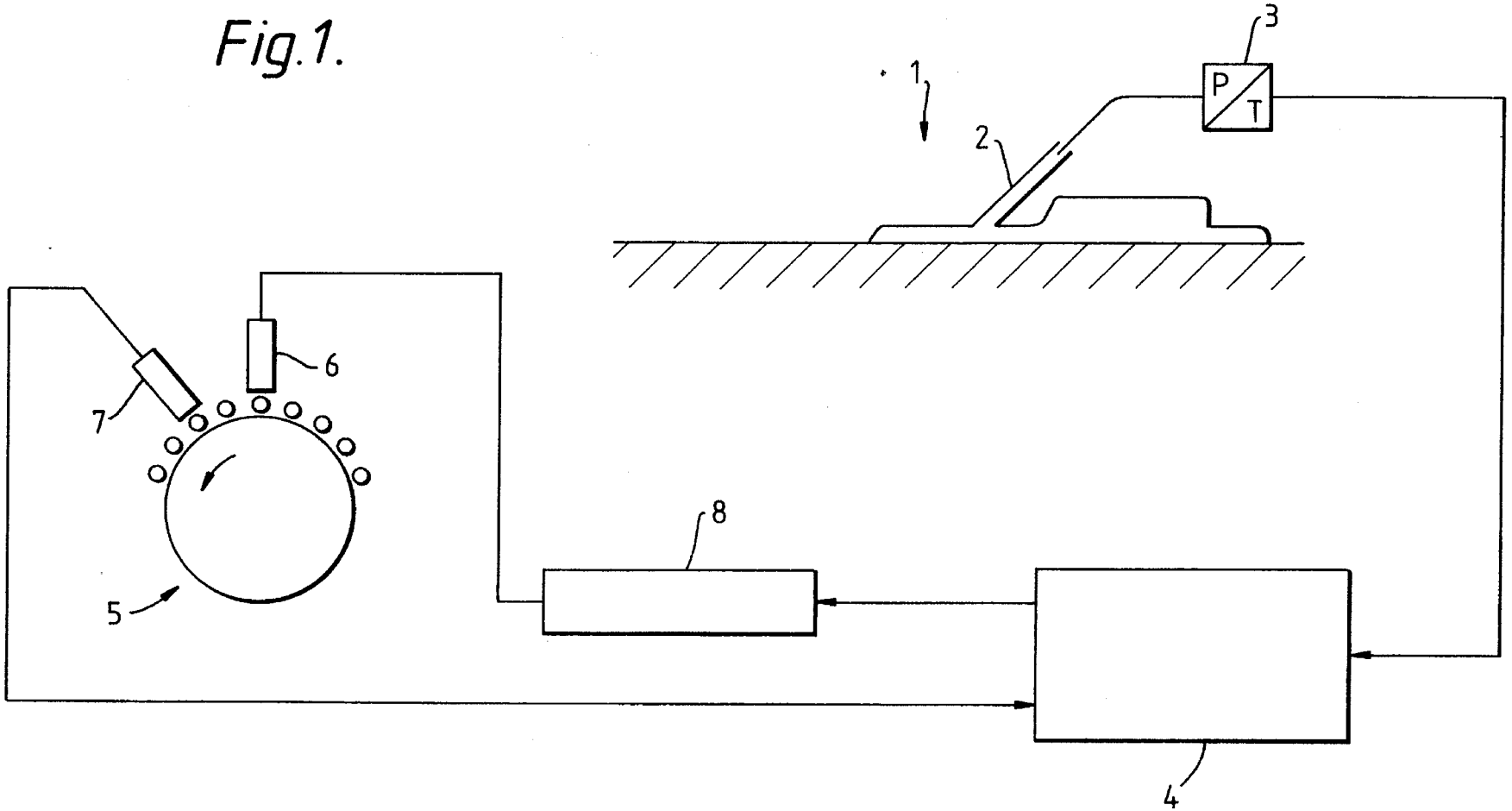
FIG. 1 shows an on-line cigarette pressure drop measuring system according to one aspect of the present invention.

FIG. 1 shows a pressure drop measuring unit 1 mounted on a cigarette making machine at the point where the formed rod of tobacco is wrapped with a paper wrapper, i.e. at or close to the garniture. At this point the rod of tobacco is compacted towards a cigarette rod diameter size, for example. The tobacco rod is, in fact, compacted to a diameter less than the diameter of a finished cigarette. This is necessary in order to allow for the sheathing of the tobacco rod with the cigarette paper wrapper. As described in U.S. Pat. No. 4,811,744, (for a conventional diameter cigarette of approximately 8 mm) the pressure drop of a gas stream of constant volume introduced into the compacted tobacco rod beneath the format finger 2 on the cigarette making machine at a point at which the tobacco rod has a diameter of about typically 7.85 mm correlates very exactly with the bound pressure drop in the finished cigarette, i.e. represents an exact reproducible measure of the draw resistance of the finished cigarette.

The pressure drop across the rod at the point at which the rod diameter is that of the finished cigarette diameter is measured by a pressure-sensor transducer 3 which furnishes the measured value corresponding to the pressure drop or difference at the rod as an electrical signal. The pressure drop signal is fed to a signal processing unit 4 wherein the bound cigarette pressure drop is obtained by correlation. In U.S. Pat. No. 4,811,744 this pressure drop measurement is known as the draw resistance of the cigarette.

An associated filter tip assembly machine 5 is provided with a laser 6 and a ventilation meter 7. The ventilation meter 7 provides a continuous measurement in known manner of the degree of ventilation of the cigarette produced as a result of perforation of the tipping wrapper after the tipping wrapper is wrapped around abutting tobacco rod lengths and filter elements. The ventilation measurement is fed to a signal processing unit 4 and utilised in the calculation of the whole cigarette unbound pressure drop.

An algorithm which has proved successful at predicting the cigarette unbound pressure drop of laser ventilated filter-tipped cigarettes, such as that described with reference to FIG. 2 hereof, is outlined below:

Unbound $PDC =$

-continued $$\left[PDR+\left(\frac{x}{x+y}\right)\cdot PDT\right]\cdot\left(1-\frac{V}{100}\right)+\left(\frac{y}{x+y}\right)\cdot PDT$$

where:

V=% ventilation

PDR=bound tobacco rod pressure drop

PDT=bound filter tip pressure drop x+y=total filter tip length (mm)

y=ventilation position from mouth end of filter tip x=ventilation position from end of filter tip remote mouth end The bound filter tip pressure drop, filter tip length, ventilation position from mouth end, and ventilation position from the end remote the mouth end are all pre-programmed into the signal processing unit 4.

The signal processing unit 4 calculates the cigarette unbound pressure drop, which pressure drop is indicative of the draw resistance experienced by the smoker. Comparator means is provided in the signal processing unit 4 to compare the derived cigarette unbound pressure drop with a pre-set target value or range of values. If the derived value is above or below the target level, the settings of the laser generator 8 can be varied to adjust the unbound cigarette pressure drop to the target value or range.

In the alternative, the signal processing unit 4 can be provided with means to provide a signal to the ecreteurs of the cigarette making machine to vary the pressure drop of the tobacco rod by increasing or decreasing the tobacco rod weight, and hence the overall unbound cigarette pressure drop.

Figure 2:
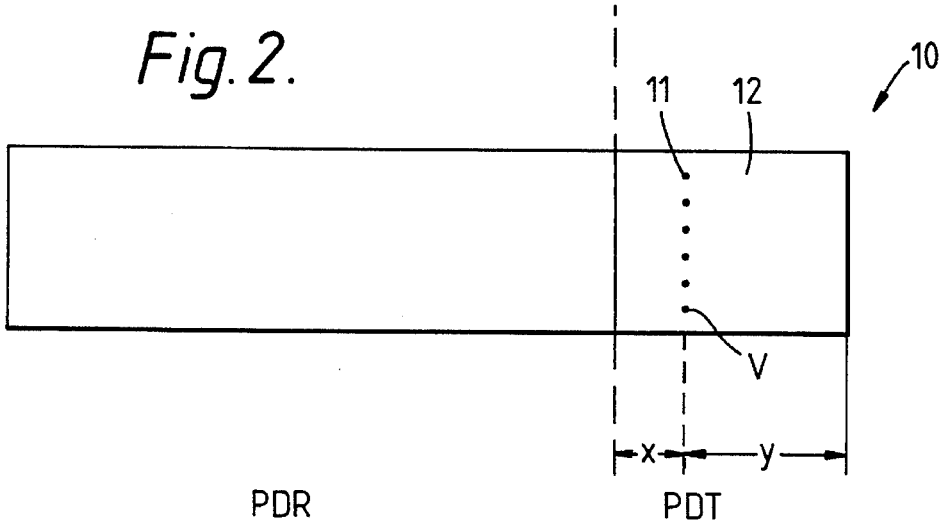
FIG. 2 shows a filter-tipped cigarette annotated in accordance with an algorithm suitable for use in the present invention.

FIG. 2 shows a filter-tipped cigarette 10 provided with ventilation perforations 11 in the filter element 12 of the cigarette 10. The filter-tipped cigarette 10 shown in FIG. 2 is also annotated in accordance with the algorithm described above with respect to FIG. 1, which algorithm is suitable for use to calculate the unbound cigarette pressure drop of the cigarette 10. The cigarette 10 is provided with a particular degree of ventilation, which degree of ventilation is monitored by a ventilation meter such as ventilation meter 7 shown in FIG. 1. The pressure drop of the filter element 12 is fed to calculation means, such as signal processing unit 4 of FIG. 1.

Figure 3:
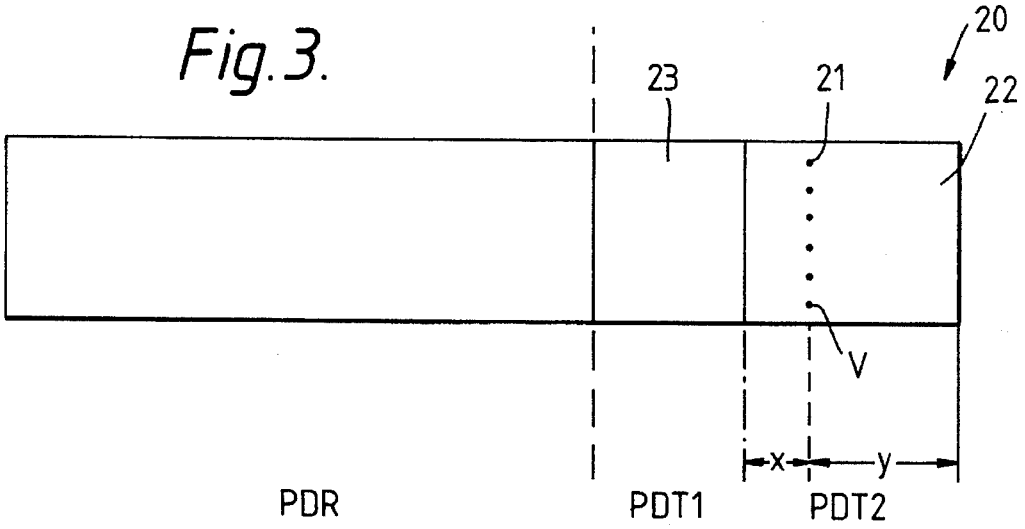
FIG. 3 shows a multi-element filter-tipped cigarette annotated in accordance with a further algorithm suitable for use in the present invention.

FIG. 3 shows a multi-element filter-tipped cigarette 20 provided with ventilation perforations 21 in filter element 22. Filter element 22 is comprised of fibrous cellulose acetate material, for example. A further filter element 23 is provided. Filter element 23 is comprised of either fibrous polyethylene material or a ribbon of polyethylene material, for example. The pressure drop of each of the filter elements 22 and 23 are fed to calculation means, such as signal processing unit 4 in FIG. 1. Multi-element filter-tipped cigarette 20 is annotated in accordance with a further algorithm described below which is suitable for use in the present invention for the calculation of the unbound pressure drop of cigarette 20.

$$\text{Unbound } PDC=\left[PDR+PDT1+\left(\frac{x}{x+y}\right)\cdot PDT2\right]\cdot\left(1-\frac{V}{100}\right)+\left[\left(\frac{y}{x+y}\right)\cdot PDT2\right]$$

where:

V=% ventilation

PDR=bound tobacco rod pressure drop

PDT1=bound filter tip pressure drop of front section of the filter tip

Figure 4:
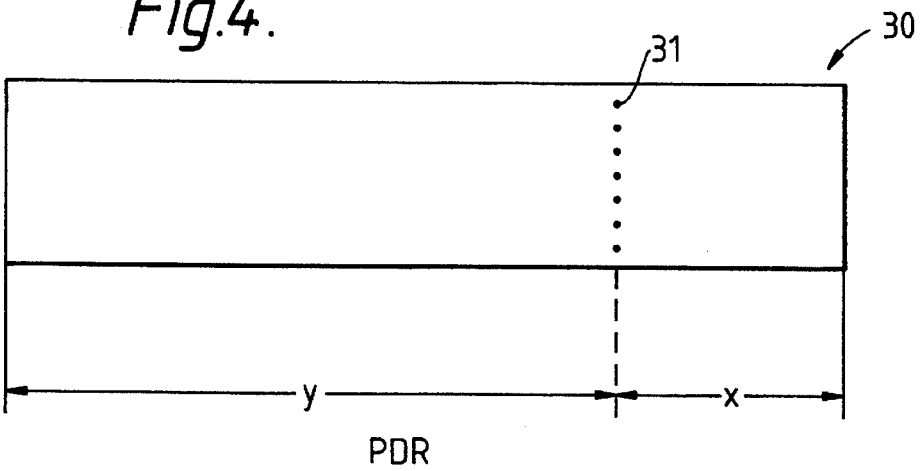
FIG. 4 shows a ventilated plain cigarette annotated in accordance with another algorithm suitable for use in the present invention.

PDT2=bound filter tip pressure drop of rear (mouth end) section of the filter tip x+y=total length of rear section filter tip (mm)

y=ventilation position from mouth end of rear section of the filter tip x=total length of rear section filter tip −y FIG. 4 shows a ventilated plain cigarette 30 provided with ventilation perforations 31. The bound pressure drop of the tobacco rod, as determined by correlation from the pressure drop measured across the rod of tobacco fibres as the rod is formed, is utilised in the calculation of the unbound cigarette pressure drop in accordance with the algorithm below:

$$\text{Unbound } PDC=\left(\frac{x}{x+y}\right)\cdot PDR\cdot+\left[\left(\frac{y}{x+y}\right)\cdot PDR\right]\cdot\left(1-\frac{V}{100}\right)$$

where:

V=% ventilation

PDR=bound tobacco rod pressure drop x+y=total length of tobacco rod (mm)

y=ventilation position from mouth end of the tobacco rod x=ventilation position from end remote mouth end of tobacco rod, or total length of tobacco rod−y In another embodiment of the invention, the measuring system may be utilised for determining the cigarette unbound pressure drop and for comparing the derived value with a target value or range of values, and rejecting by rejection means those cigarettes which do not fall within the desired range or value.

In those embodiments in which pre-perforated tipping wrappers or naturally porous tipping wrappers are used, the algorithm outlined above may need refinement in order to more accurately predict the cigarette unbound pressure drop.

As an alternative to measuring the pressure drop across the tobacco rod at a constant gas volume, the measuring system may be arranged to measure the gas volume passing with constant pressure drop through the cigarette. The pressure-sensor transducer 3 must then be replaced by a volume meter.

It is to be noted that the point at which the pressure drop across the tobacco rod is measured will vary depending on the diameter of the finished cigarette to be produced. The measuring position will need to be determined experimentally to find that position at which the pressure drop across the rod correlates with the bound pressure drop along the finished cigarette for each cigarette of other than conventional diameter.

We claim:

1. A method of determining the unbound cigarette pressure drop of finished ventilated cigarettes before their completion which comprises measuring the pressure drop across a rod of tobacco fibers as the rod is formed on a cigarette making machine, by passing a gas stream across the rod of tobacco fibers and detecting the pressure drop as an electrical signal using pressure sensitive means, the pressure drop being measured as the rod is compacted in a format finger of said cigarette making machine at a point along the rod in the format finger where the pressure drop measured across the rod correlates with a bound tobacco rod pressure drop measurement along the rod when the rod of tobacco fibers is in a finished wrapped condition; the electrical signal being indicative of a particular pressure drop measurement and calculating using calculation means an unbound cigarette pressure drop for a finished ventilated filter-tipped cigarette made from said rod, the calculation means utilizing the bound tobacco rod pressure drop obtained by correlation with the measured pressure drop across the rod in an algorithm held by the calculation means, which algorithm is determined by the specific filter element design of the completed cigarette.

2. A method of determining cigarette pressure drop according to claim 1, wherein the degree of ventilation of the finished cigarette is utilised in the calculation of the unbound cigarette pressure drop.

3. A method of determining cigarette pressure drop according to claim 2, wherein the degree of ventilation of the finished cigarette is determined by means of a ventilation meter in association with said cigarette making machine.

4. A method of determining cigarette pressure drop according to claim 1, wherein the method provides for feeding of the value of a desired degree of ventilation to said calculation means.

5. A method of determining cigarette pressure drop according to claim 4, wherein the value of a desired degree of ventilation is provided by the utilisation of a tipping wrapper having been prior provided with means to produce a known degree of ventilation in a finished cigarette, in conjunction with a porous filter plugwrap or self-sustaining filter rod.

6. A method of determining cigarette pressure drop according to claim 1, wherein the method includes the further steps of comparing the calculated or desired unbound cigarette pressure drop value with a pre-set target unbound pressure drop value or range of values.

7. A method of determining cigarette pressure drop according to claim 6, wherein after comparison of the calculated and target unbound cigarette pressure drop values, a cigarette parameter is varied to maintain the unbound cigarette pressure drop to the target value or within the target range.

8. A method of determining cigarette pressure drop according to claim 7, wherein the cigarette parameter which is varied is one or more of the degree of ventilation of the cigarette, the pressure drop of the rod, or the position of the ventilation perforations either along the tobacco rod or the filter element.

9. A method of determining cigarette pressure drop according to claim 6, wherein after comparison of the calculated and target unbound cigarette pressure drop values, those cigarettes which do not have an unbound cigarette pressure drop value of the target value or within the desired range are rejected.

10. A method of determining cigarette pressure drop according to claim 7, wherein the cigarette parameter to be varied or the rejection of unsuitable cigarettes is automatically achieved.

11. A method of determining cigarette pressure drop according to claim 1, wherein the calculation of the unbound cigarette pressure drop is continuously calculated to provide a means for continuously monitoring the unbound cigarette pressure drop.

12. A cigarette pressure drop measuring system adapted to measure pressure drop across a rod of tobacco fibers as the rod is formed on a cigarette making machine at a point along the rod where the pressure drop measured correlates with the bound tobacco rod pressure drop of the rod in a finished condition, which comprises a format finger in a cigarette making machine through which a rod of tobacco fibers passes;

a source of gas disposed to pass gas across the rod of tobacco fibers; and a gas pressure detecting means located to detect the gas passing across the rod of tobacco fibers;

there being further provided calculation means for calculating the unbound pressure drop of a finished ventilated plain or filter-tipped cigarette, the calculation means utilizing the bound tobacco rod pressure drop obtained by correlation with the measured pressure drop across the rod in an algorithm held by the calculation means.

13. A cigarette pressure drop measuring system according to claim 12, wherein the system incorporates a ventilation meter adapted to provide a measurement of the degree of ventilation of a cigarette.

14. A cigarette pressure drop measuring system according to claim 13, wherein the system further comprises a laser perforator which perforates tipping wrapper.

15. A cigarette pressure drop measuring system according to claim 12, wherein the measuring system comprises comparator means operable to compare the desired unbound cigarette pressure drop value provided by the measuring system with a predefined unbound cigarette pressure drop target value or range of values.

16. A cigarette pressure drop measuring system according to claim 15, wherein there is further provided means to vary a parameter of the cigarette to maintain the unbound cigarette pressure drop value to or within pre-set limits.

17. A cigarette pressure drop measuring system according to claim 12, wherein signal processing means is provided to process measured values into a corresponding electrical signal and vice-versa.

18. A cigarette pressure drop measuring system according to claim 16, wherein said ventilation meter is linked by means of a feedback signal to said laser perforator whereby the laser settings of said laser perforator can be regulated thereby providing means to vary a parameter of the cigarette to maintain the degree of ventilation of the cigarette to a target level or within a target range.

19. A cigarette pressure drop measuring system according to claim 15, wherein rejection means is provided to reject those cigarettes which do not have an unbound cigarette pressure drop value within the pre-set limits or of the pre-set value.

20. A cigarette pressure drop measuring system according to claim 16, wherein means is provided to link the ecreteurs of the cigarette making machine with a signal processing unit, whereby the tobacco weight of the tobacco can be varied in order to increase or decrease the tobacco rod pressure drop and to maintain the unbound cigarette pressure drop within or to a pre-set level.

21. A method of determining the unbound cigarette pressure drop of finished ventilated cigarettes before their completion, which comprises measuring the pressure drop across a rod of tobacco fibres as the rod is formed on a cigarette making machine by passing a gas stream across the rod of tobacco fibres and detecting the pressure drop as an electrical signal using pressure sensitive means, the pressure drop being measured as the rod is compacted in a format finger of said cigarette making machine at a point along the rod in the format finger where the pressure drop measured across the rod correlates with a bound tobacco rod pressure drop measurement along the rod when the rod of tobacco fibres is in a finished wrapped condition, the electrical signal being indicative of a particular pressure drop measurement, and calculating using calculation means an unbound cigarette pressure drop for a finished ventilated filter-tipped cigarette made from said rod, the calculation means utilising the bound tobacco rod pressure drop obtained by correlation with the measured pressure drop across the rod in an algorithm held by the calculation means, which algorithm is determined by the specific filter element design of the completed cigarette, and further comparing the calculated unbound cigarette pressure drop value with a preset target range, and either varying a cigarette parameter to maintain the cigarette pressure drop within the target range, or rejecting those cigarettes which do not have an unbound pressure drop within the target range.

22. A method according to claim 21 wherein the cigarette parameter which is varied is one or more of the degree of ventilation of the cigarette, the pressure drop of the rod, or the position of the ventilation perforations either along the tobacco rod or the filter element.

23. A method according to claim 22 wherein the cigarette parameter to be varied or the rejection of unsuitable cigarettes is automatically achieved.

* * * * *